United States Patent [19]

Moore et al.

[11] 4,353,651

[45] Oct. 12, 1982

[54] METHOD OF MIXING CHEMICALLY BONDED FOUNDRY SAND BY VIBRATORY ACTION

[76] Inventors: William H. Moore, Whitehall Apts.-6E, Whitehall Rd., Chattanooga, Tenn. 37405; Donald R. Jorgensen, R.F.D. 1, Udell Ct., Peekskill, N.Y. 10566

[21] Appl. No.: 173,991

[22] Filed: Jul. 31, 1980

[51] Int. Cl.[3] ..... B28C 5/08

[52] U.S. Cl. ..... 366/2; 366/114; 366/128

[58] Field of Search ..... 366/2, 128, 53, 31, 366/111, 114, 116, 108, 6, 10

[56] References Cited

U.S. PATENT DOCUMENTS

| | | | |
|---|---|---|---|
| 2,882,024 | 4/1959 | Behrens | 366/128 |
| 3,161,993 | 12/1964 | Balz | 366/128 |
| 3,464,674 | 9/1969 | Pick | 366/128 |
| 3,572,653 | 3/1971 | Boenisch | 366/53 |
| 3,871,623 | 3/1973 | Boenisch | 366/111 |
| 3,877,178 | 4/1973 | Campanelli | 366/128 |

FOREIGN PATENT DOCUMENTS

| | | | |
|---|---|---|---|
| 519270 | 6/1976 | U.S.S.R. | 366/128 |

*Primary Examiner*—Robert W. Jenkins

*Attorney, Agent, or Firm*—Woodling, Krost & Rust

[57] ABSTRACT

A method of mixing chemically bonded foundry sand by introducing the sand and binders into a lengthwise extending spiral shaped mixing trough and vibrating the trough is disclosed.

4 Claims, 4 Drawing Figures

METHOD OF MIXING CHEMICALLY BONDED FOUNDRY SAND BY VIBRATORY ACTION

Our invention relates to a method of mixing foundry sands by vibratory action.

Foundry sands are currently mixed on a continuous basis in screw or other type of mechanical mixer. All of the mixers available for this purpose contain augers with blades or screw mechanisms that revolve in a trough or a bowl to which sand and binders are added. The mixing is accomplished by intensive mechanical action which requires relatively high power for a given quality of mixing. Further than this, because of physical wear, the blades or augers have to be replaced and adjusted on a regular basis.

Our invention is based on the discovery that foundry sands may be mixed by means of a vibratory action. This action can be generated with little power for a given quality of mixing. This vibratory action mixes the sand without benefit of any moving mechanical parts such as blades, augers or screws. No physical wear is present; no replacement of mixing parts is necessary.

An object of our invention is to rapidly mix foundry sands.

Another object is to mix foundry sands without any mechanical parts that are subject to wear adjustment or need of replacement.

Another object is to mix foundry sands with very little power in relation to the amount of mixing taking place.

Still other objects will become apparent from the specification and drawings, in which.

Figure 1:
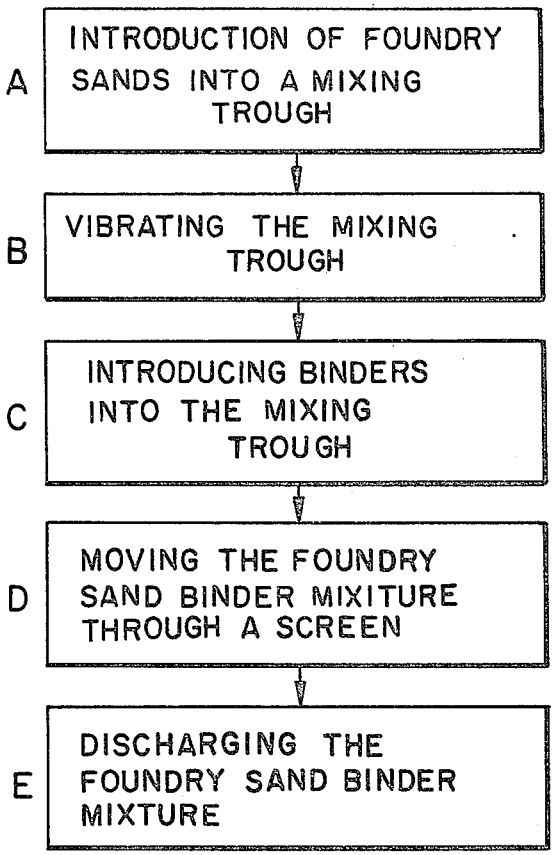
FIG. 1 is a flow diagram of the steps of our method.

FIG. 1 details the steps of our method in its preferred form.

The first step of my method is the introduction of foundry sands into a mixing trough (step A of FIG. 1). The mixing trough can be of any shape or configuration; the circular trough shown in the remaining figures is preferred.

Figure 2:
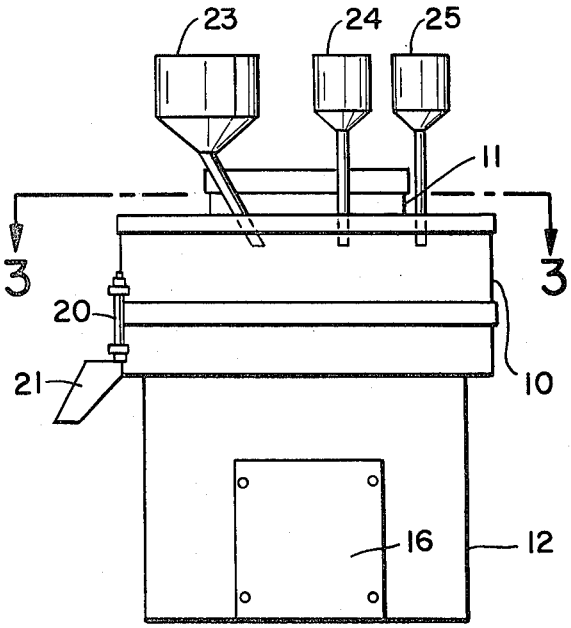
FIG. 2 is a side view of a circular path vibratory mixing machine capable of preforming the vibratory action of our method of mixing foundry sands.

The second step of our method is to vibrate the mixing trough containing the foundry sands (step B of FIG. 1). The vibratory action can be of any type (up and down, side to side), circular, et al.) and magnitude, varied as the qualities of the foundry sands and binders and speed of mixing action dictate. The pitch and yaw vibratory action produced by the mixing apparatus of FIG. 2 is preferred.

The third step of our method is the introduction of binders into the mixing trough containing the foundry sands (step C of FIG. 1). These binders chemically harden the sand. They may be of single or multiple parts. The timing of the introduction of the binders into the mixing trough is dependent upon the movement of the foundry sands, the speed of the set up time of the binders, the quantity of material desired and other such considerations. The timing of the introduction of the binders can be varied by the actual timing of introduction, the speed or quality of the binders, by the relative physical positions of the binder hoppers in respect to each other and the foundry sands, and other ways. In the case of multi-part binders and a linear (as opposed to contiguous) mixing trough the physical positions of the binder hoppers is important. A slow setting-up two-part binder would have the catalyst introduced relatively near the location of the introduction of the resin and a distance from the discharge opening. A fast setting-up two-part binder would have the catalyst introduced much closer to the discharge opening than to the location of the introduction of the resin.

The fourth step (optional) of our method is to move the foundry sands and binder through a screen (step D of FIG. 1). The screen can be of any shape or configuration. The screen serves to break up any lumps in the foundry sand mixture and to otherwise facilitate the mixing action. Optional small balls or other physical items of a size too large to fit through the screen introduced before the screen further facilitate the mixing action by a synergistic co-operation with the screen.

The fifth step of our method is to discharge the foundry sands and binders as mixed by the vibratory action (step E of FIG. 1). The discharge may be by any means; an opening in the bottom or side of the mixing trough is preferred. With such a discharge the vibratory action of the mixing trough facilitates discharge.

Figure 3:
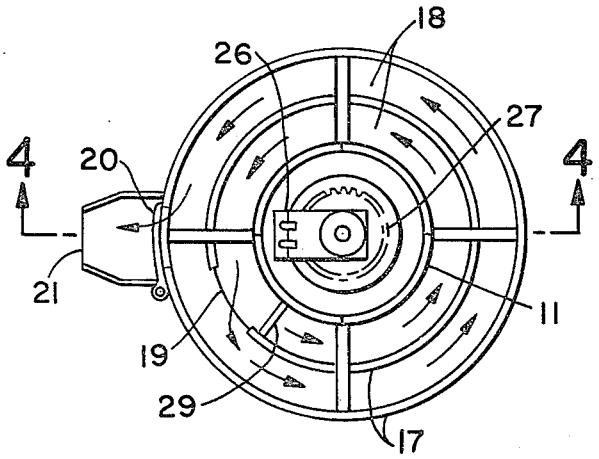
FIG. 3 is a top view of the circular path vibratory mixing machine of FIG. 2 taken generally from lines 3—3 in FIG. 2.
Figure 4:
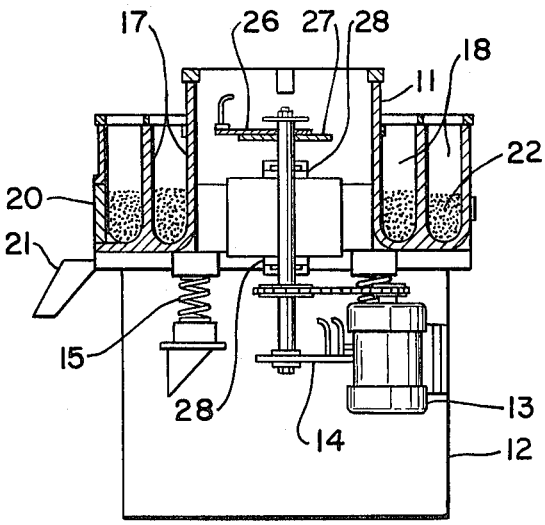
FIG. 4 is a cross-sectional view of the circular path vibratory mixing machine of FIG. 2 taken generally along lines 4—4 in FIG. 3.

FIGS. 2, 3 and 4 disclose a mixing machine capable of preforming the steps of my method. In these FIGURES: 10 is the outer bowl of the mixer containing an inner sleeve 11 to isolate the vibratory mechanism and a lower support shell 12 serving as a housing for the motor 13, the lower eccentric 14, the spring support 15 and the drive access door 16. The bowl 10 is fitted with a trough liner 17 to provide two annular concentric troughs 18. The outer trough is connected to the inner trough by means of a perforated plate 19 and the outer trough contains a discharge door 20 connected to a discharge chute 21. Sand 22 shown in the troughs is added by means of the sand delivery hopper 23 and binders are added through the delivery hoppers 24 and 25. The upper vibration is caused by the upper eccentric 26; the position of this upper eccentric being adjusted by the sprocket device 27. The eccentrics are rotated through a pulley drive and a shaft held in bearings 28 and driven by the motor 13. The flow of sand is diverted from the inner trough by means of a dam or stopper 29 through a perforated plate 19 to the outer trough.

In use, sand is added by the hopper 23 while the mixer is being vibrated by the two eccentric weights 26 and 14. The binders or chemicals are added by the hoppers 24 and 25, and the sand flows by vibratory action along the inner trough to the stopper 29 through the perforated plate 19 to the outer trough, and finally through the discharge door 20 at which point it has been thoroughly mixed and is ready for use. The perforated plate 19 serves to break up any lumps that may have formed in the inner trough. The position and weight of the eccentrics 26 and 14 may be altered to provide more or less intensity of vibration to change both the speed and efficiency of the mixing action. The eccentric weights are usually driven in the same direction as the travel path of the sand body.

We have found that one or more eccentrics combined with springs will provide a motion in both the vertical and horizontal planes simultaneously. This is akin to the pitch and yaw experienced by a boat in the ocean. Such a motion, coupled with a "U" shaped trough in the mixing vessel, provides a rolling action to the sand which results in rapid mixing of the ingredients added. It also results in an overall lateral movement of the same body.

When the binders used to chemically harden the sand are viscous and sticky, as in the case with a material like sodium silicate, the tendency is to form small lumps in the sand mix which prevent uniform dispersion of the sodium silicate in the sand. We have found that "balling up" of this nature can be eliminated by providing a perforated screen in the system which breaks up lumps and balls, thereby allowing the binder to be uniformly dispersed over the sand particles. In some cases, we have found that the inclusion of metal cylinders or balls in the mixer aid considerably in forcing the "balled up" material through the perforated screens. Where we use two "U" shaped channels in the mixer, a convenient place to put the perforated screen is where the first channel opens into the second channel, see item 19.

For binder systems, at least 2 ingredients are added to the sand, usually a binder and a catalyst or accelerator to speed up the chemical action. Typical sands are furan bonded sands, phenolic bonded sands and sodium silicate bonded sands. Most are typified by self-hardening by chemical action sometime after mixing. In the process of our invention, we add these ingredients to the sand at various points along the trough of the mixer by dispensing them by a gravity feed, or by using calibrated liquid pumps. In any case, we find it convenient to change the location of the points of binder addition according to the speed of action of the ingredients used. Thus, a quick acting catalyst may be added late in the cycle as would be the case in using certain phenolic binders, whereas an acid hardening material could be added early in the cycle before the actual binder is added, as would be the case in furan binders where toluene sulphonic acid or benzene sulphonic acids are the hardeners and furfuryl alcohol resin is the binder.

The speed of mixing may be varied by changing the amount of vibration conferred by the eccentrics or by increasing the length of travel of the sand by using one or more troughs, or by increasing the diameter of the mixer. This type of mixing allows great flexibility for the many types of chemical binders that are in use today.

For mixing on a continuous basis, we add a continuous supply of sand to the mixer. The mixed sand is discharged at the same rate as that which is added, and the various binder ingredients are added at a pre-determined rate according to the percentage by weight or volume required to produce a sand for a given purpose.

For mixing on a batch basis, a weighed quantity of sand is introduced into the mixer; the ingredients are added and the discharge door is opened only when the mixing is judged to be complete.

As an example of the method of this invention, a two-trough mixer with the troughs at diameters of 20" and 28" respectively was filled with sand at the rate of 50 pounds per minute. Benzene sulphonic acid was added in the amount of 0.2 pound per minute at a point 6" from where the sand entered the first trough. Furan binder was added in the amount of 0.5 pounds per minute at a point in the first trough about 12" from the perforated disc entry to the second trough. The dwell time in the mixer was 150 seconds and the mixed sand was continuously discharged at a rate of 50 pounds per minute. The mixed sand was used to make cores for foundry molds and during the total running time of 10 minutes, three samples were taken of the mixed sand and rammed with standard test cores. These cores were tested after 12 hours standing time and found to have tensile strengths of 180, 210 and 190 pounds per square inch respectively. All the foundry cores made during this time were satisfactory. The same sand with the same quantities of ingredients was also mixed in a standard paddle mixer and the 12 hour tensile strength was found to be 205 pounds per square inch, indicating that the method of our invention produced a good furan sand mix. We have also produced sands bonded with 4% sodium silicate binder and 0.4% di-acetin as a hardener and found that these sands compare favorably in properties in comparison to the same sands mixed in conventional paddle mixers.

We have found that sand mixes at the rate of 50 to 80 pounds per minute may be produced by vibration mixing, using a motor of ¾ H.P. at 80 pounds per minute. This corresponds to a power usage of 1 horsepower per 100 pounds sand per minute. This compares with screw type and paddle type mixers that mix about 1000 pounds per minute with 30 H.P. or 33 pounds per minute per horsepower. We have found also that vibratory mixing will require little or no maintenance as there are no moving parts which can wear. The operating costs associated with this type of mixing are extremely low.

Although this invention has been described in its preferred form and preferred practice with a certain degree of particularity, it is understood that the present disclosure of the preferred form and preferred practice has been made only by way of example and that numerous changes in the details of construction and the combination and arrangement of parts and steps may be resorted to without departing from the spirit and the scope of the invention as hereinafter claimed.

What is claimed is:

1. A method for mixing foundry sand with two part chemical binders comprising the steps of locating the place of introduction of the first part of the binder in respect to a lengthwise extending mixing trough, locating the place of introduction of the second part of the binder in respect to the mixing trough, introducing the sand into one end of the mixing trough, vibrating the mixing trough causing the sand to turn over, the sand laterally moving in the mixing trough sequentially past the places of introduction of the first part and second part of the binder respectively, introducing the first part and second part of the binder into the mixing trough, said vibrating the mixing trough also mixing the sand and two part chemical binder, and discharging the sand and two part chemical binder mixture from the other end of the mixing trough.

2. The method according to claim 1 wherein the place of introduction of the second part of the binder is located in respect to the length of the mixing trough such that the second part of the binder is completely mixed by the vibration of the mixing trough with the sand-first part of the binder combination before the discharge.

3. The method according to claim 1 wherein the place of introduction of the first part of the binder is located in respect to the length of the mixing trough such that the first part of the binder is completely mixed by the vibration of the mixing trough with the sand before the place of introduction of the second part of the binder.

4. The method according to claim 1 wherein the lengthwise extending mixing trough is shaped substantially in the shape of a spiral, the sand introduced into the inner end of the spiral and the sand-two part binder mixture discharged from the outer end of the spiral.

* * * * *